US007424242B2

(12) United States Patent
Syring et al.

(10) Patent No.: US 7,424,242 B2
(45) Date of Patent: Sep. 9, 2008

(54) METHOD AND APPARATUS FOR SECURING A PRINTING DEVICE

(75) Inventors: Harold J. Syring, Little River, TX (US); Michael E. Gleason, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 333 days.

(21) Appl. No.: 11/288,564

(22) Filed: Nov. 29, 2005

(65) Prior Publication Data

US 2007/0122184 A1 May 31, 2007

(51) Int. Cl.
*G03G 15/00* (2006.01)
*B41F 17/00* (2006.01)

(52) U.S. Cl. ..... 399/107; 101/494; 399/393; 399/411

(58) Field of Classification Search ..... 399/107, 399/393; 101/494
See application file for complete search history.

(56) References Cited

U.S. PATENT DOCUMENTS 5,720,012 A 2/1998 McVeigh et al.
6,456,258 B1 * 9/2002 Bragg et al. ..... 343/892
6,522,532 B2 2/2003 Liao et al.
6,836,405 B2 12/2004 Alfonso et al.
6,917,519 B2 7/2005 Coyle et al.
2007/0251405 A1 * 11/2007 Kurokawa et al. ..... 101/494

FOREIGN PATENT DOCUMENTS

JP 2000137542 A * 5/2000
JP 2001121795 A * 5/2001

OTHER PUBLICATIONS www.troygroup.com/securityprinting/products, Jan. 30, 2006.

* cited by examiner

*Primary Examiner*—David M Gray
*Assistant Examiner*—Erika J. Villaluna
(74) *Attorney, Agent, or Firm*—Haynes and Boone, LLP

(57) ABSTRACT

A printing device securing apparatus includes a printing device having a first securing member operable to couple to an external locking device. An input tray includes a second securing member operable to couple to an external locking device, wherein the input tray is operable to couple to the printing device such that the first securing member is adjacent the second securing member. With the input tray coupled to the printing device, an external locking device may be coupled to the first securing member and the second securing member in order to secure the printing device and the input tray if security is an issue.

23 Claims, 11 Drawing Sheets

METHOD AND APPARATUS FOR SECURING A PRINTING DEVICE

BACKGROUND

The present disclosure relates generally to information handling systems, and more particularly to securing a printing device which may be coupled to an information handling system.

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Many information handling systems include a printing device which is coupled to the information handling system. Typical printing devices generally include an input tray which is loaded with a printing medium such as, for example, paper, and coupled to the printing device in order to allow the printing device to access the printing medium and print to it. The securing of the printing device and the input tray raises a number of issues.

In some situations it may be desirable to secure the printing device and the input tray, such as, for example, when a user provides the printing device in a public space such that the printing device and the printing medium are subject to theft.

Conventional printer securing devices generally involve devices that are secured to the printer and a larger entity such as, for example, a table or a wall. However, such conventional solutions do not provide for the securing of the input tray, leaving the printing medium subject to theft. Conventional input tray securing devices provide a built-in lock which allows the input tray to be secured in the printing device in order to protect the printing medium. However, such conventional solutions raise the cost of the printing device, which is undesirable, especially considering that there will be many users who wish to provide the printing device in a private space and hence have no need to secure either the printing device nor the input tray.

Accordingly, it would be desirable to provide for securing a printing device absent the disadvantages found in the prior methods discussed above.

SUMMARY

According to one embodiment, a printing device securing apparatus includes a printing device having a first securing member operable to couple to an external locking device, and an input tray including a second securing member operable to couple to an external locking device, wherein the input tray is operable to couple to the printing device such that the first securing member is adjacent the second securing member.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

Figure 1:
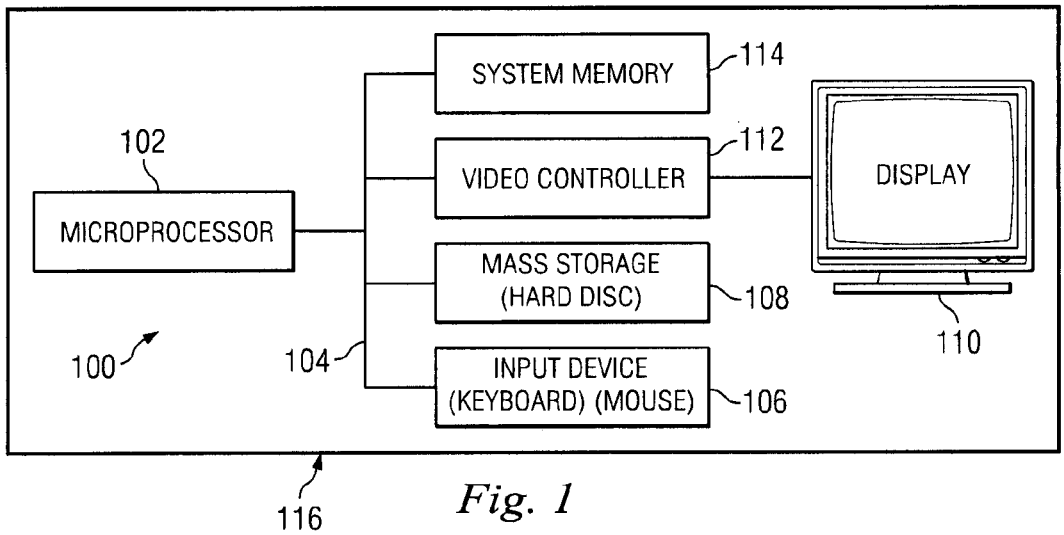
FIG. 1 is a schematic view illustrating an embodiment of an information handling system.

In one embodiment, information handling system 100, FIG. 1, includes a microprocessor 102, which is connected to a bus 104. Bus 104 serves as a connection between microprocessor 102 and other components of computer system 100. An input device 106 is coupled to microprocessor 102 to provide input to microprocessor 102. Examples of input devices include keyboards, touchscreens, and pointing devices such as mouses, trackballs and trackpads. Programs and data are stored on a mass storage device 108, which is coupled to microprocessor 102. Mass storage devices include such devices as hard disks, optical disks, magneto-optical drives, floppy drives and the like. Information handling system 100 further includes a display 110, which is coupled to microprocessor 102 by a video controller 112. A system memory 114 is coupled to microprocessor 102 to provide the microprocessor with fast storage to facilitate execution of computer programs by microprocessor 102. In an embodiment, a chassis 116 houses some or all of the components of information handling system 100. It should be understood that other buses and intermediate circuits can be deployed between the components described above and microprocessor 102 to facilitate interconnection between the components and the microprocessor.

Figure 2A:
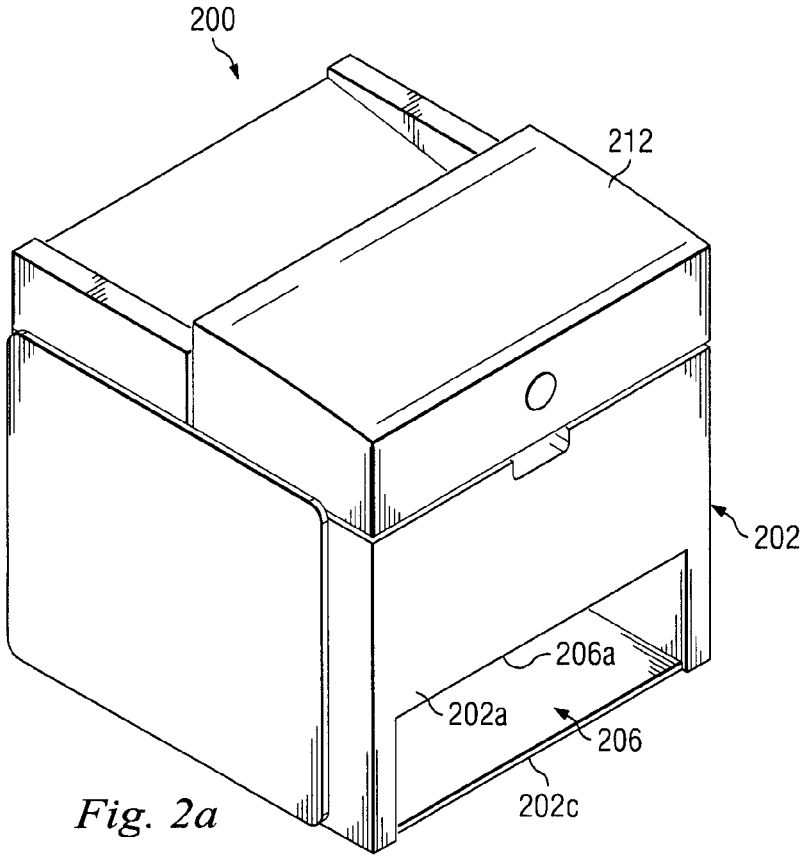
FIG. 2*a* is a front perspective view illustrating an embodiment of a printing device.
Figure 1C:
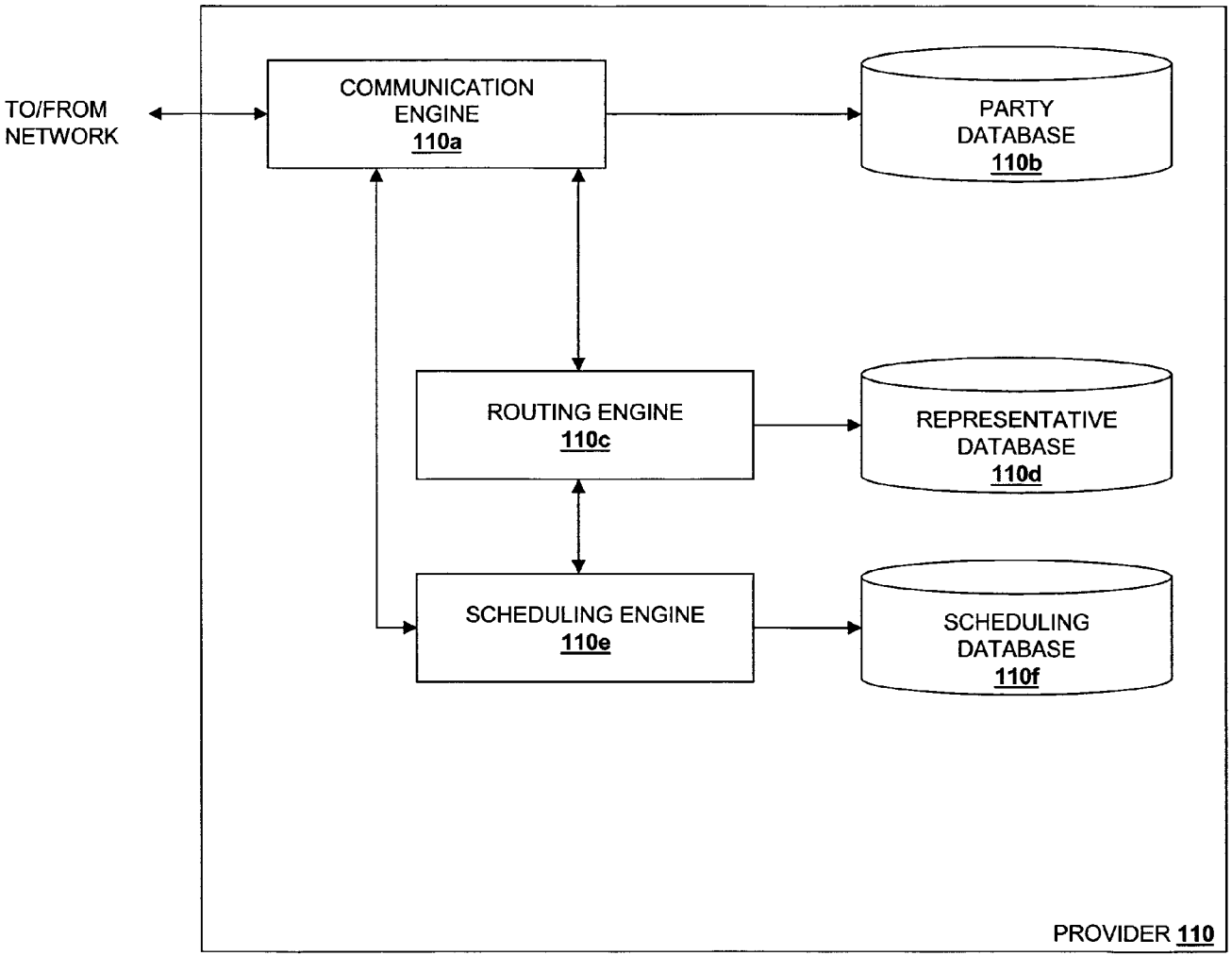
Figure 2A:
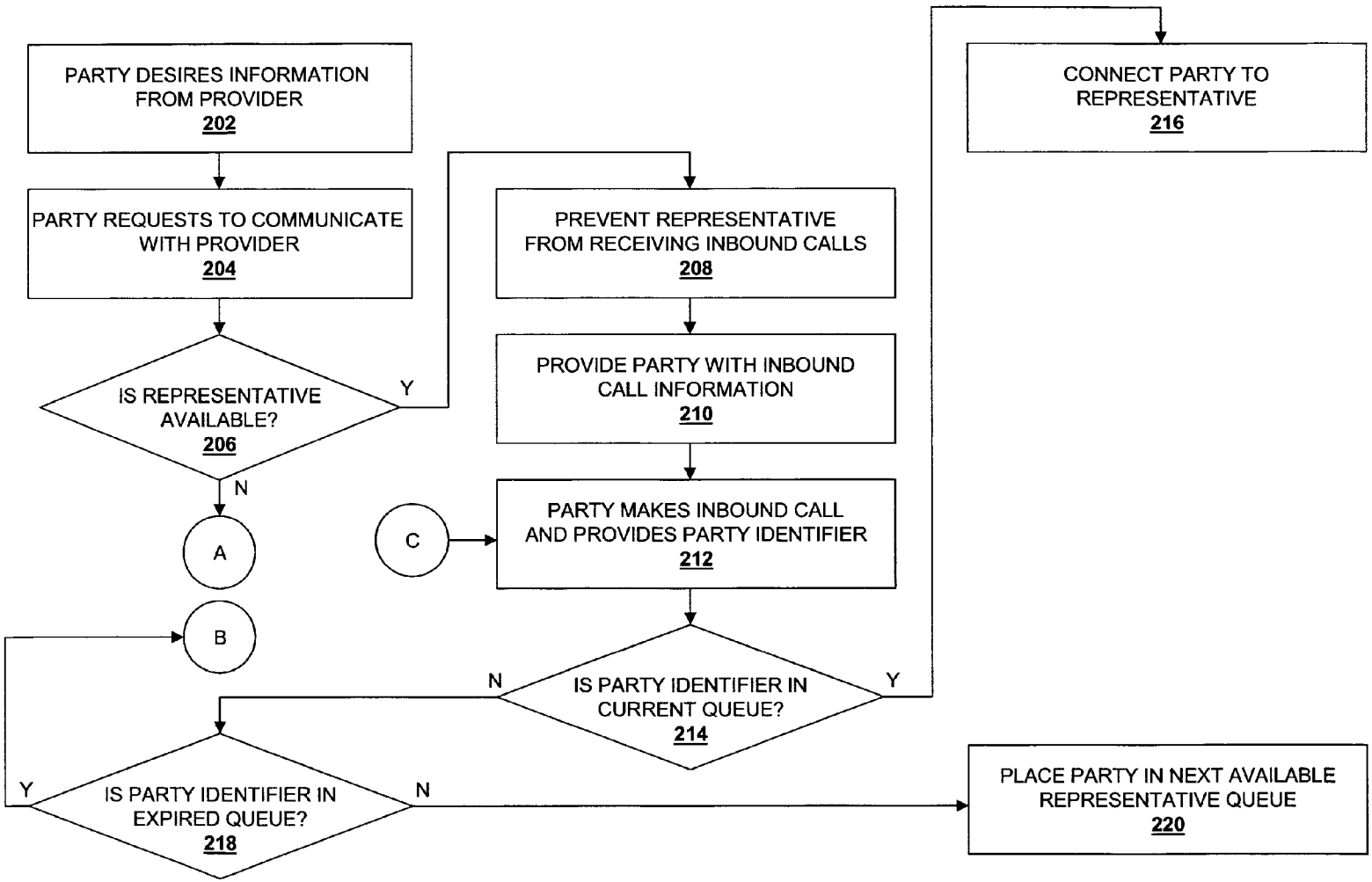
Figure 2B:
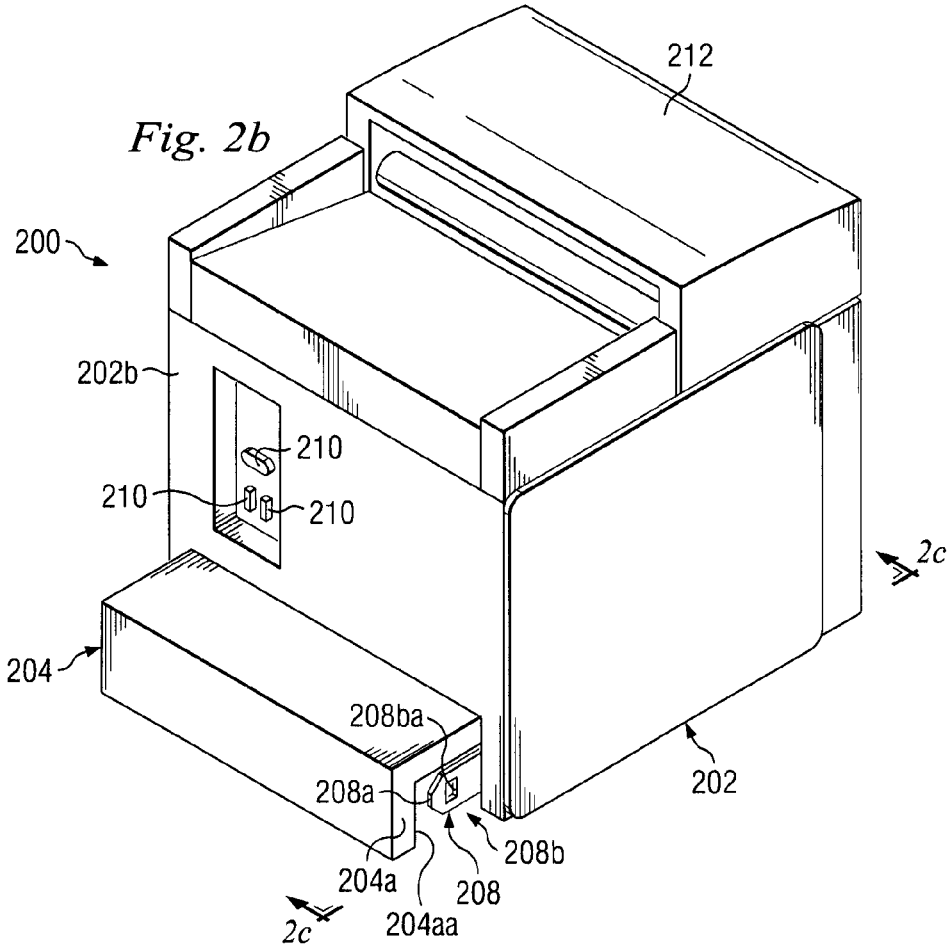
FIG. 2*b* is a rear perspective view illustrating an embodiment of the printing device of FIG. 2*a*.
Figure 2C:
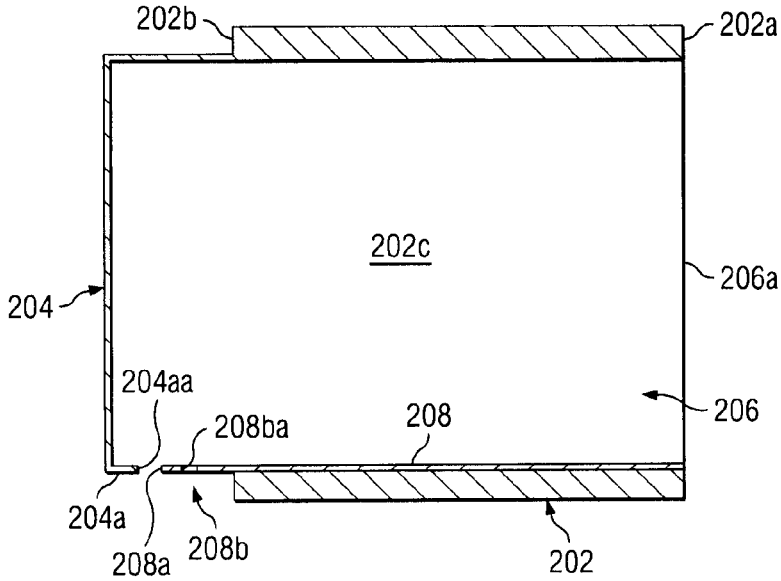
FIG. 2*c* is a cross sectional view illustrating an embodiment of the printing device of FIG. 2*b*.

Referring now to FIGS. 2*a*, 2*b*, and 2*c*, a printing device 200 is illustrated. The printing device 200 includes a base 202 having a front surface 202*a*, a rear surface 202*b* located opposite the front surface 202*a*, and a bottom surface 202*c* extending between the front surface 202*a* and the rear surface 202*b*. A base extension 204 extends from the rear surface 202*b* of the base 202 adjacent the bottom surface 202*c*. The base extension 204 includes a side surface 204*a* and defines a securing member opening 204*aa* through the side surface 204*a*. The base 202 and the base extension 204 define an input tray passageway 206 which is located adjacent the bottom surface 202*c* of the base 202 and extends from a passageway entrance 206*a* to the base extension 204. A first reinforced member 208 is coupled to the base 202 and is located adjacent the input tray passageway 206. The first reinforced member 208 includes a distal end 208*a* having a first securing member 208*b* which is located adjacent the securing member opening 204*aa* and in the input tray passageway 206. In an embodiment, the first securing member 208*b* is a first slot 208*ba* which is defined by the first reinforced member 208 and located adjacent the securing member opening 204*aa*. In an embodiment, the first slot 208*ba* includes dimensions which are industry standards for a conventional KENSINGTON type lock, available from Kensington Computer Products Group, http://us.kensington.com. A plurality of information handling system connectors 210 are located on the rear surface 202*b* of the base 202. A printing mechanism 212 is coupled to the base 202 and extends into the base 202 such that the printing mechanism 212 has access to the input tray passageway 206. In an embodiment, the printing mechanism 212 is a conventional printing mechanism known in the art for printing to a printing medium.

Figure 3A:
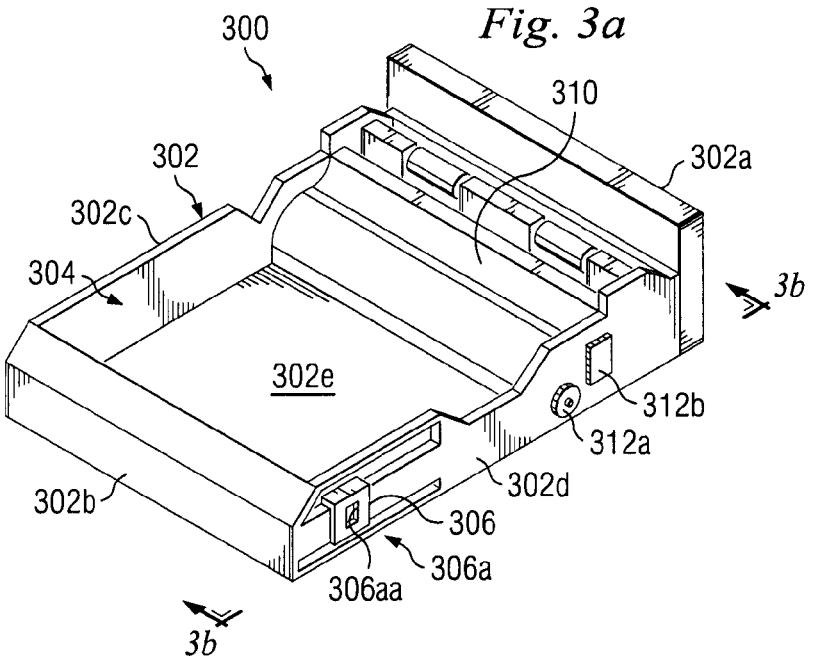
FIG. 3*a* is a perspective view illustrating an embodiment of an input tray.
Figure 3B:
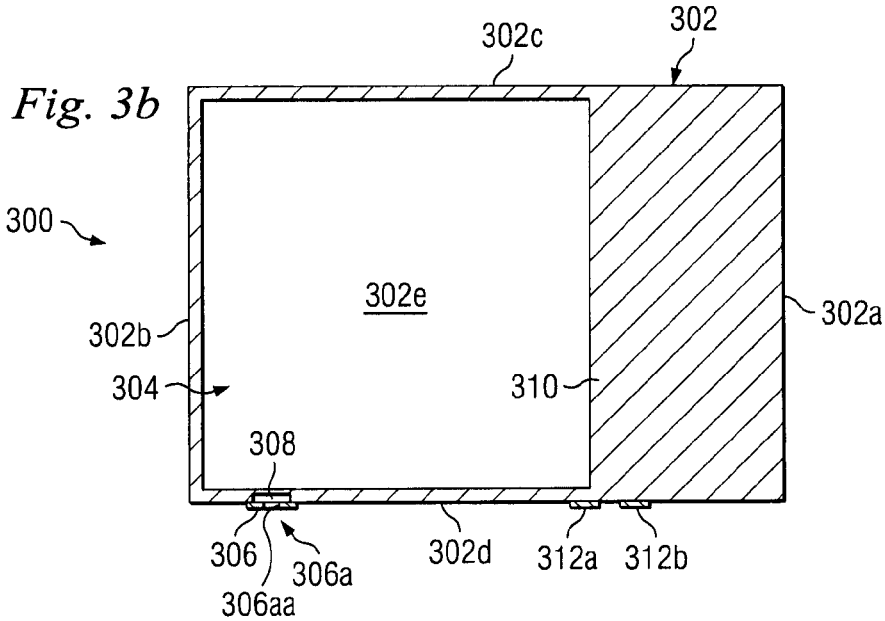
FIG. 3*b* is a cross sectional view illustrating an embodiment of the input tray of FIG. 3*a*.

Referring now to FIGS. 3*a* and 3*b*, an input tray 300 is illustrated. The input tray 300 includes a base 302 having a front surface 302*a*, a rear surface 302*b* located opposite the front surface 302*a*, a pair of opposing side surfaces 302*c* and 302*d* extending between the front surface 302*a* and the rear surface 302*b*, and a bottom surface 302*e* extending between the front surface 302*a*, the rear surface 302*b*, and the side surfaces 302*c* and 302*d*. A printing medium channel 304 is defined by the base 302 and is located adjacent the bottom surface 302*e* between the front surface 302*a*, the rear surface 302*b*, and the side surfaces 302*c* and 302*d*. A second reinforced member 306 is located on the side surface 302*d* of the base 302 and adjacent the rear surface 302*b*. The second reinforced member 306 includes a second securing member 306*a* which is centrally located on the second reinforced member 306. In an embodiment, the second securing member 306*a* is a second slot 306*aa* which is defined by the second reinforced member 306*a* and located adjacent a securing channel 308 which is defined by the base 302. In an embodiment, the second slot 306*aa* includes dimensions which are industry standards for a conventional KENSINGTON type lock, available from Kensington Computer Products Group, http:llus.kensington.com. A feed mechanism 310 is coupled to the input tray 300 and located between the printing medium channel 304 and the front surface 302*a* of the base 302. A plurality of feed mechanism actuators 312*a* and 312*b* are located on the side surface 302*d* and couple to the feed mechanism 310 through the base 302.

Figure 4:
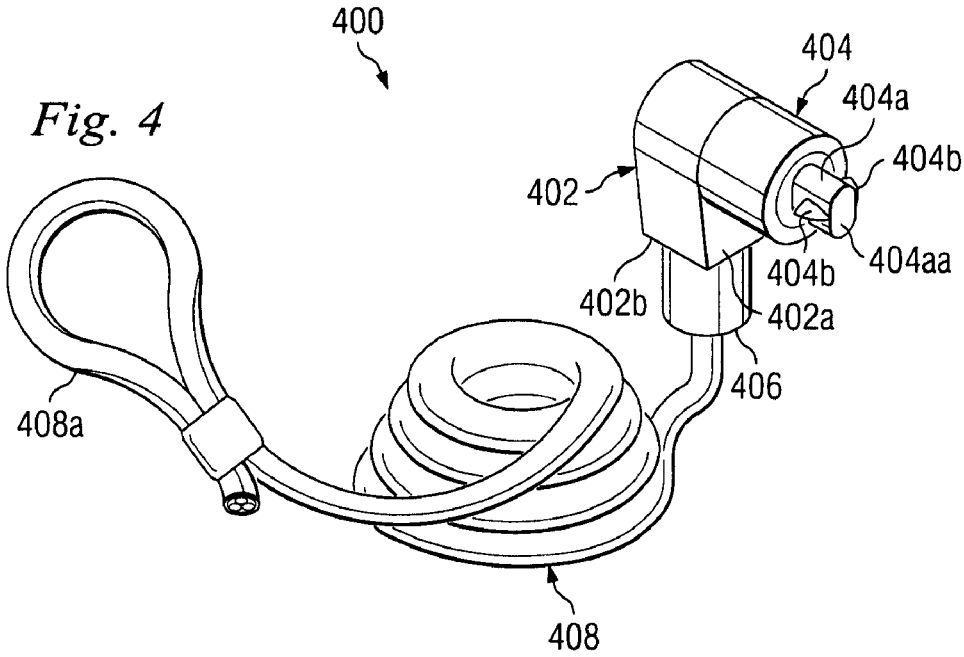
FIG. 4 is a perspective view illustrating an embodiment of an external locking device.

Referring now to FIG. 4, an external locking device 400 is illustrated. The external locking device 400 includes a base 402 having a front surface 402*a* and a bottom surface 402*b* oriented substantially perpendicularly to the front surface 402*a*. A locking member 404 extends from the front surface 402*a* of the base 402 and includes a beam 404*a* having a distal end 404*aa*. A plurality of locking arms 404*b* extend from opposite sides of the beam 404*a* and are located adjacent the distal end 404*aa*. A reinforced member 406 extends from the bottom surface 402*b* of the base 402, and a cord 408 extends from the reinforced member 406. The cord 408 includes a securing loop 408*a* located on a distal end of the cord 408. In an embodiment, the external locking device 400 is a conventional KENSINGTON type lock, available from Kensington Computer Products Group, http://us.kensington.com.

Referring now to FIGS. 1, 2*b*, 5*a* and 5*b*, a method 500 for securing a printing device is illustrated. The method 500 begins at step 502 where the printing device 200, described above with reference to FIG. 2*b*, is provided. In an embodiment, a table securing entity 502*a* is provided which includes a support surface 502*aa* and a leg 502*ab*. The printing device 200 is positioned on the table securing entity 502*a* such that the bottom surface 202*c* of the printing device 200 engages the support surface 502*aa* of the table securing entity 502*a*. In an embodiment, the table securing entity 502*a* may be replaced by a variety of different securing entities known in the art such as, for example, a wall or other relatively immobile entity. In an embodiment, the printing device 200 may be coupled to an information handling system such as, for example, the information handling system 100 described above with reference to FIG. 1, through the information handling system connectors 210.

Figure 5A:
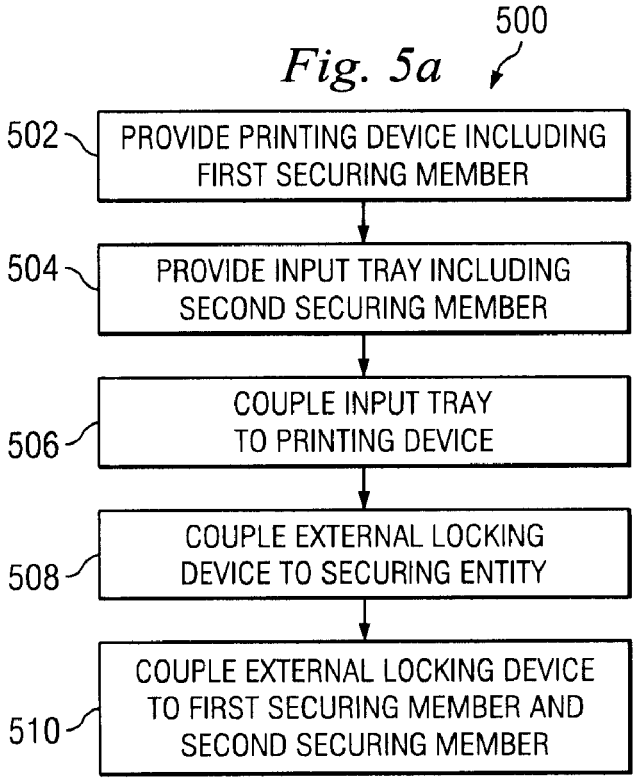
FIG. 5*a* is a flow chart illustrating an embodiment of a method for securing a printing device.
Figure 5B:
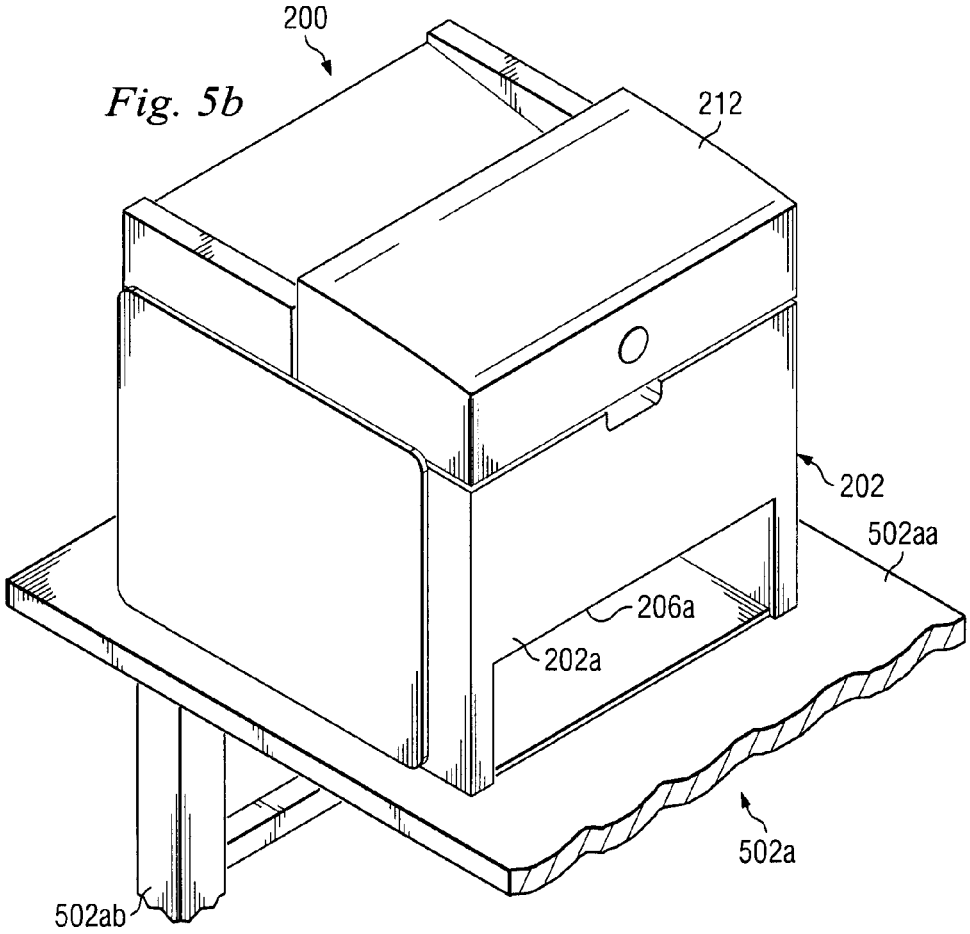
FIG. 5*b* is a perspective view illustrating an embodiment of the printing device of FIGS. 2*a*, 2*b*, and 2*c* positioned on a securing entity.
Figure 5D:
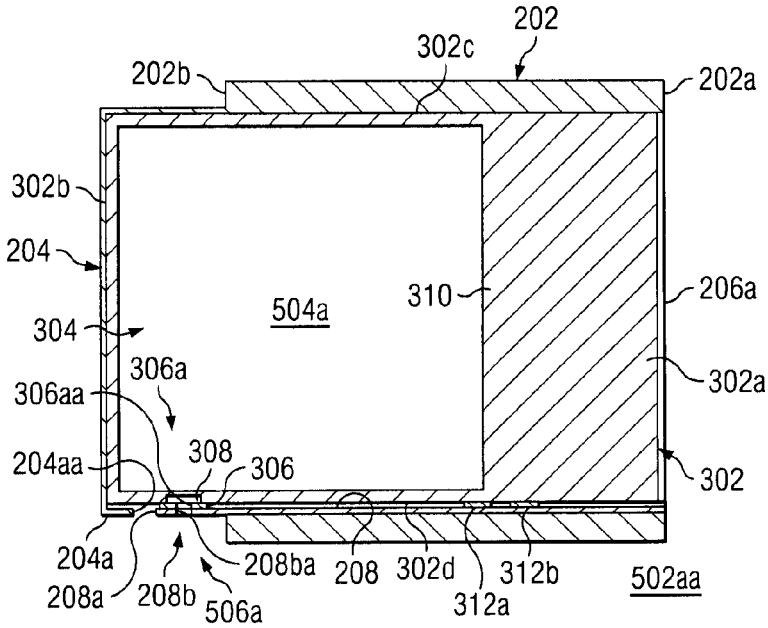
FIG. 5*d* is a cross sectional view illustrating an embodiment of the input tray of FIG. 3 coupled to the printing device of FIG. 5*b*.
Figure 5C:
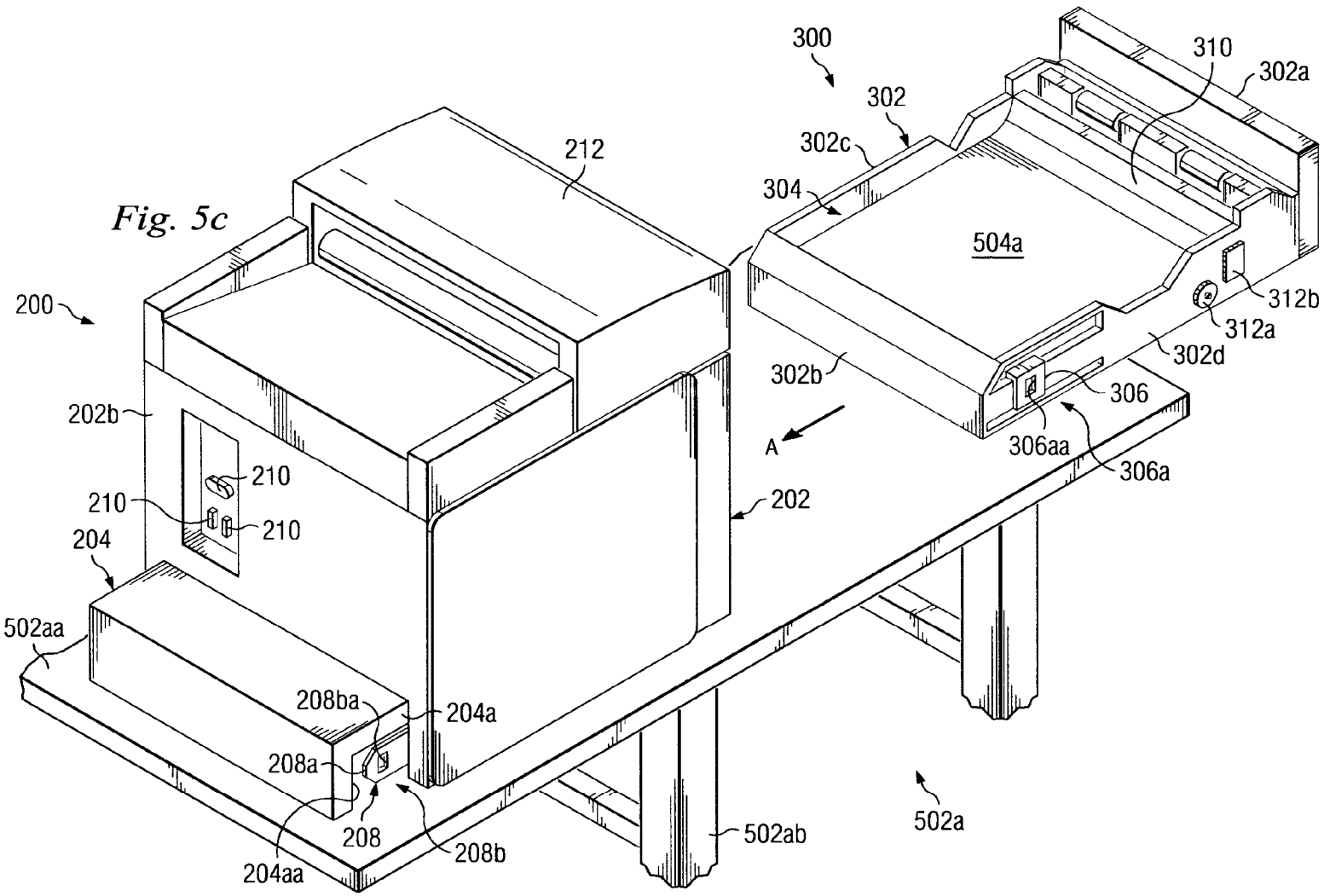
FIG. 5*c* is a perspective view illustrating an embodiment of the input tray of FIG. 3 being coupled to the printing device of FIG. 5*b*.

Referring now to FIGS. 2*a*, 5*a*, 5*c*, and 5*d*, the method 500 proceeds to step 504 where the input tray 300, described above with reference to FIG. 3, is provided. In an embodiment, a printing medium 504*a* is positioned in the printing medium channel 304. In an embodiment, the printing medium 504*a* may be a conventional printing medium known in the art such as, paper, photo paper, letterhead, transparencies, cardstock, and a variety of other printing media. The method 500 then proceeds to step 506 where the input tray 300 is coupled to the printing device 200. The input tray 300 is positioned adjacent the printing device such that the rear surface 302*b* of the input tray 300 is adjacent the passageway entrance 206*a* on the front surface 202*a* of the printing device 200, as illustrated in FIG. 5*c*. The input tray 300 is then moved in a direction A such that the rear surface 302*b* of the input tray 300 enters the input tray passageway 206. Continued movement of the input tray 300 in the direction A results in the input tray 300 being coupled to the printing device in the input tray passageway 206, with the rear surface 302*b* of the input tray 300 engaging the base extension 204 and the second securing member 306*a* being positioned adjacent the first securing member 208*b* such that the second slot 306*aa* on the second securing member 306*a* is substantially aligned with the first slot 208*ba* on the first securing member 208*b*, as illustrated in FIG. 5*d*. In an embodiment, the first securing member 208*b* and the second securing member 306*a* provide a printing device securing apparatus 506*a*. In an embodiment, the base 202 of printing device 200 includes a drive mechanism which engages the feed mechanism actuators 312*a* and 312*b* when the input tray 300 is coupled to the printing device 200. In an embodiment, when security of the printing device 200 and the printing medium 504*a* is not an issue, the printing mechanism 212 on the printing device 200 may now be used to print to the printing medium 504*a*.

Figure 5E:
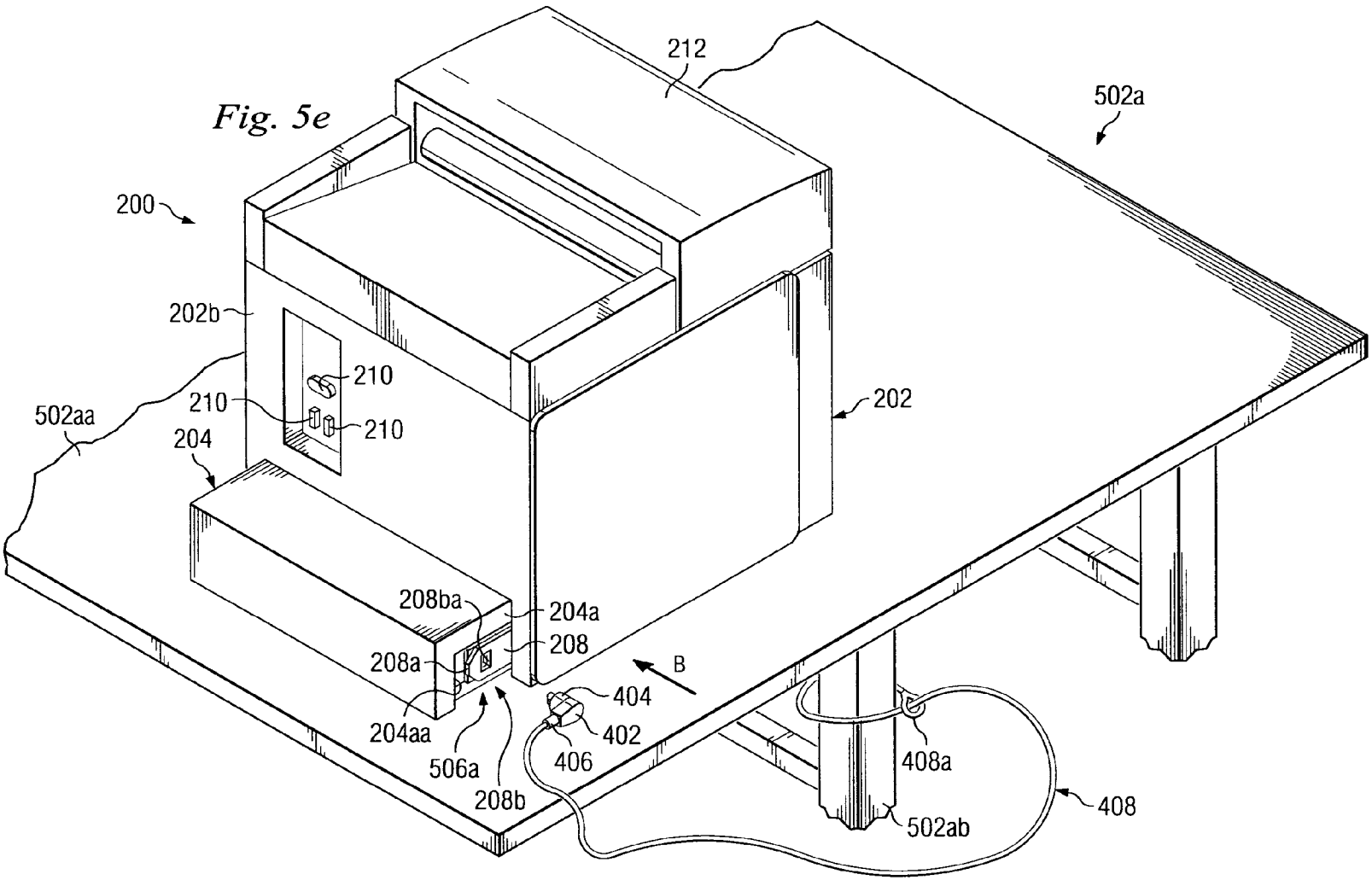
FIG. 5*e* is a perspective view illustrating an embodiment of the external locking device of FIG. 4 being coupled to the input tray and the printing device of FIGS. 5*c* and 5*d*.
Figure 5F:
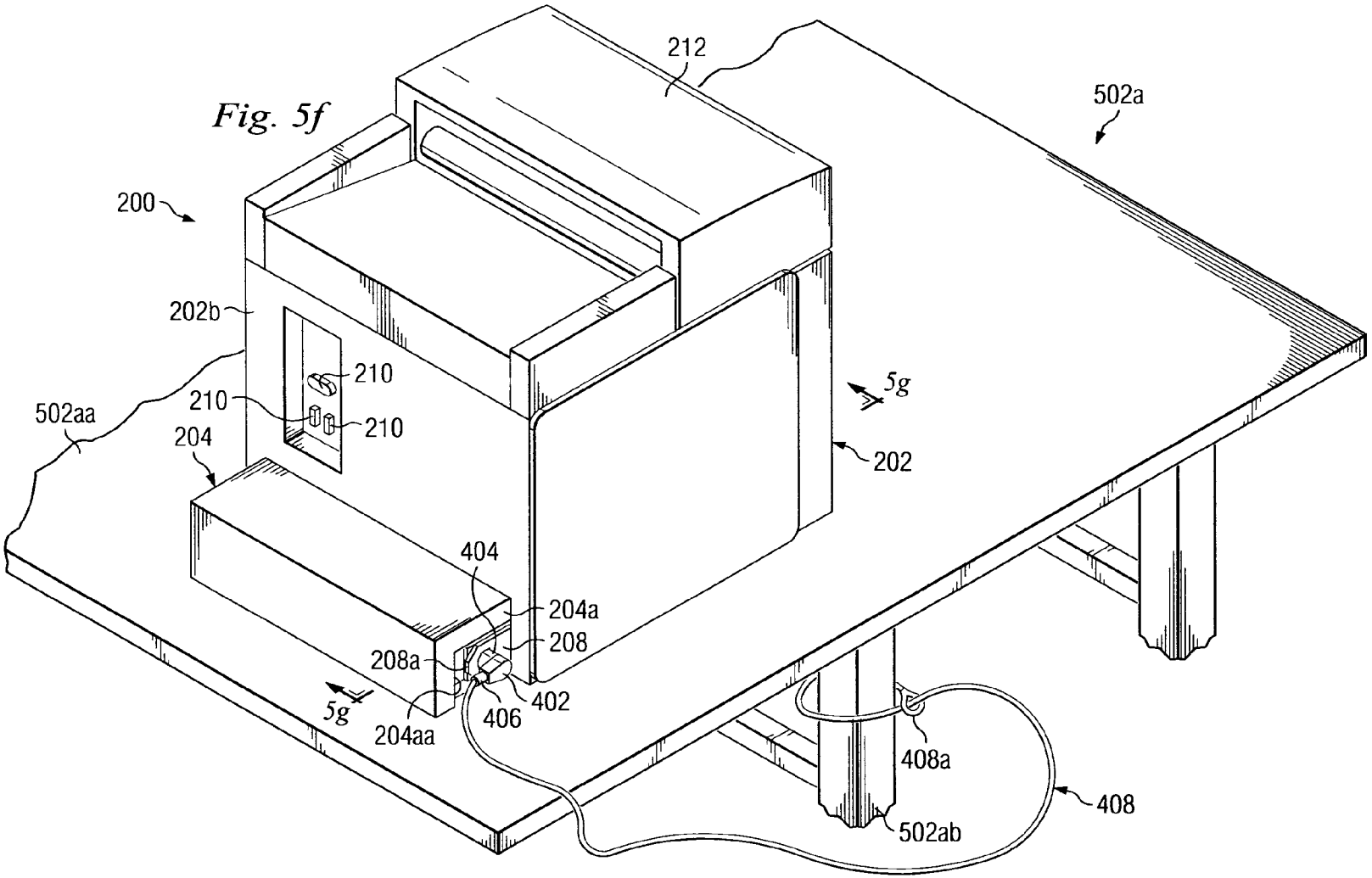
FIG. 5*f* is a perspective view illustrating an embodiment of the external locking device of FIG. 4 being coupled to the input tray and the printing device of FIGS. 5*c* and 5*d*.
Figure 5G:
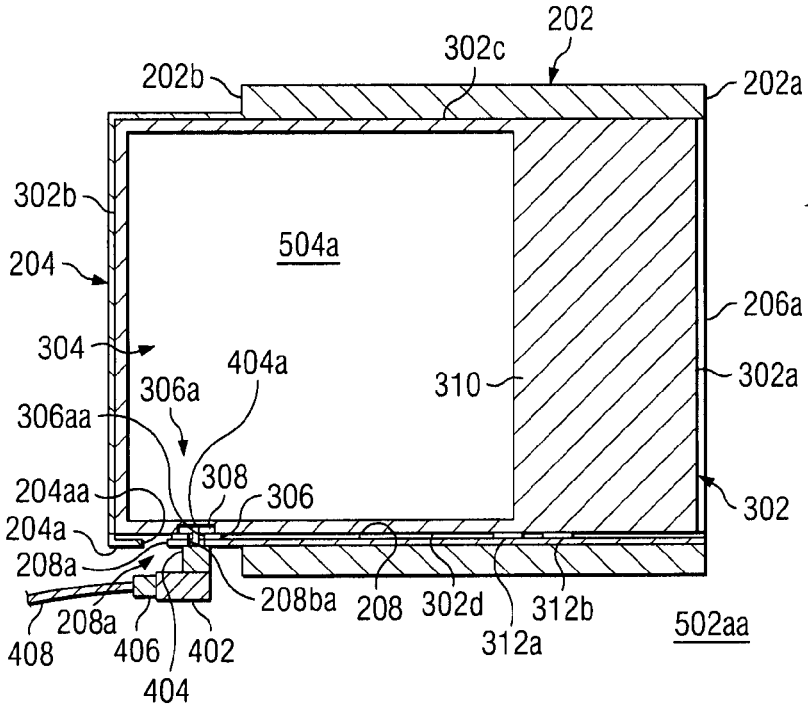
FIG. 5*g* is a cross sectional view illustrating an embodiment of the external locking device of FIG. 4 being coupled to the input tray and the printing device of FIGS. 5*c* and 5*d*.
Figure 5H:
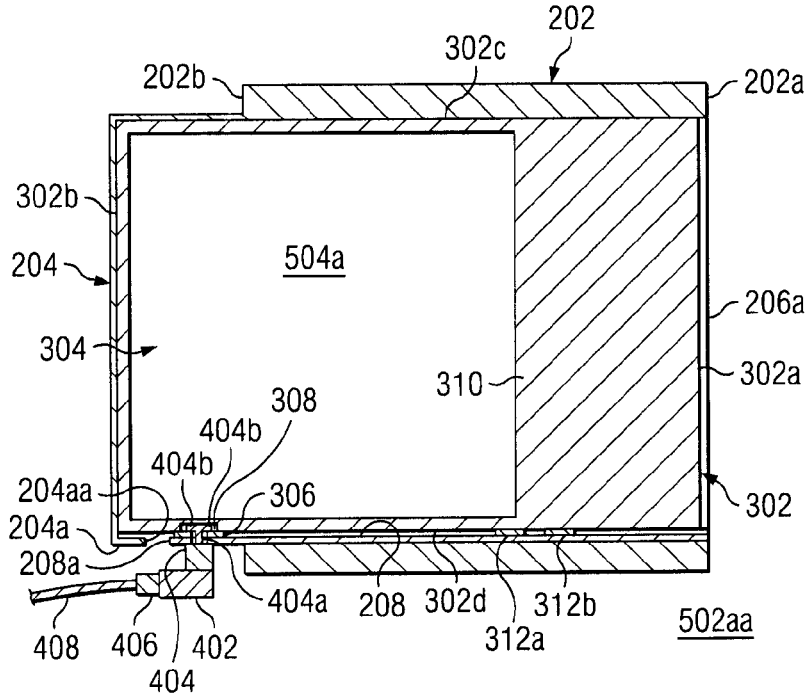
FIG. 5*h* is a cross sectional view illustrating an embodiment of the external locking device of FIG. 4 coupled to the input tray and the printing device of FIGS. 5*c* and 5*d*.

Referring now to FIGS. 2*a*, 2*b*, 2*c*, 3*a*, 3*b*, 4, 5*a*, 5*e*, 5*f*, 5*g*, and 5*h*, the method 500 proceeds to step 508 where the external locking device 400, described above with respect to FIG. 4, is coupled to the securing entity 502*a*. When security of the printing device 200 and the printing medium 504*a* is an issue, the cord 408 of the external locking device 400 is positioned around the leg 502*ab* of the securing entity and the base 402 is then pulled through the securing loop 408*a*, as illustrated in FIG. 5*e*. In an embodiment, the external locking device 400 may be coupled to a variety of securing entities known in the art using a variety of methods known in the art such as, for example, padlocking the securing loop 408*a* to an relatively immobile object. The method 500 then proceeds to step 510 where the external locking device 400 is coupled to the first securing member 208*b* and the second securing member 306*a*. The locking member 404 of the external locking device 400 is positioned adjacent the securing member opening 204*aa* such that the beam 404*a* and the locking arms 404*b* are aligned with the first slot 208*ba* and the second slot 306*aa*. The locking member 404 is then moved in a direction B, as illustrated in FIG. 5*e*, such that the beam 404*a* extends through the first slot 208*ba* and the second slot 306*aa* and the distal end 404*aa* of the beam 404*a* and the locking arms 404*b* are positioned in the securing channel 308, as illustrated in FIG. 5*g*. The beam 404*a* is then rotated about its axis such that the locking arms 404*b* are moved through the securing channel 308, securing the beam 404*a* in the first slot 208*ba* and the second slot 306*aa*, as illustrated in FIG. 5*h*, due to the engagement of the locking arms 404*b* with the second reinforced member 306, and the locking of the locking member 404 to prevent rotation about its axis. The printing device 200 is now secured to the securing entity 502*a* and the input tray 300 is secured in the printing device 200, preventing theft of the printing device 200 and the printing medium 504*a*. Thus, a method and apparatus a printing device which is relatively cheap to manufacture and which allows a user to provide an external locking device to secure the printing device and the printing medium if security is an issue. While the first securing member 208*b* and the second securing member 306*a* have been illustrated and described including a first slot 208*ba* and a second slot 306*aa* which accept a conventional KENSINGTON type lock, a variety of securing members which are known in the art are envisioned to allow the printing device and the input tray to be secured without departing from the teachings of this disclosure.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A printing device securing apparatus, comprising:

a printing device defining a printing medium input tray passageway and a securing member opening located adjacent the printing medium input tray passageway, comprising a first reinforced member that defines a first securing member slot and that is located between the securing member opening and the printing medium input tray passageway such that the first reinforced member is operable to couple to an external locking device through the securing member opening, and comprising a drive mechanism;

a printing medium input tray comprising a feed mechanism and a second reinforced member that defines a second securing member slot and that is operable to couple to an external locking device, wherein with the printing medium input tray located in the input tray passageway and coupled to the printing device, the drive mechanism engages the feed mechanism and the first securing member slot is aligned with the second securing member slot such that the external locking device may extend through the securing member opening, the first securing member slot, and the second securing member slot; and a printing mechanism located on the printing device and operable to print to a printing medium supplied by the printing medium input tray.

2. The apparatus of claim 1, wherein the printing mechanism is operable to print to photo paper that is located in the printing medium input tray and that is fed to the printing mechanism in part by the operation of the drive mechanism and the feed mechanism.

3. The apparatus of claim 1, wherein the external locking device that is operable to couple to the first reinforced member and the second reinforced member comprises a base that is separate from the printing device and the printing medium input tray, a cord that is operable to couple to a securing entity, and a locking member that is operable to extend through the securing member opening, the first securing member slot, and the second securing member slot, and wherein with the external locking device coupled to the first reinforced member and the second reinforced member, the base of the external locking device does not engage the printing device or the printing medium input tray.

4. The apparatus of claim 1, wherein the first securing member slot and the second securing member slot comprise the same dimensions.

5. The apparatus of claim 1, wherein the printing device comprises a base extension that defines the securing member opening.

6. The apparatus of claim 5, wherein the base extension defines a portion of the printing medium input tray passageway.

7. The apparatus of claim 1, wherein the second reinforced member defines a securing channel, and wherein the first securing member slot and the second securing member slot comprise dimensions such that an external lock may extend through the first securing member slot and the second securing member slot and into the securing channel, and wherein the external lock may be locked such that the external lock engages the second reinforced member and cannot be removed through the first securing member slot and the second securing member slot without being unlocked.

8. The apparatus of claim 1, further comprising:

a printing medium positioned in the printing medium input tray, whereby the printing medium input tray is coupled to the printing device and the first securing member slot and the second securing member slot are aligned.

9. The apparatus of claim 8, further comprising:

an external locking device extending through the first securing member slot and the second securing member slot while being coupled to a securing entity, whereby the external locking device prevents the printing medium input tray from being decoupled from the printing device.

10. An information handling system, comprising:

a microprocessor, a storage coupled to the microprocessor;

a printing device coupled to the microprocessor, whereby the printing device defines a printing medium input tray passageway and a securing member opening located adjacent the printing medium input tray passageway, comprises a first reinforced member that defines a first slot that is located between the securing member opening and the printing medium input tray passageway such that the first reinforced member is operable to accept an external locking device through the securing member opening, and comprises a drive mechanism;

a printing medium input tray comprising a feed mechanism and a second reinforced member that defines a second slot and that is operable to accept an external locking device, wherein the printing medium input tray is operable to be positioned in the input tray passageway and coupled to the printing device such that the drive mechanism engages the feed mechanism and the first slot and the second slot are aligned such that the external locking device may extend through the securing member opening, the first slot, and the second slot; and a printing mechanism located on the printing device and operable to print to a printing medium supplied by the printing medium input tray.

11. The system of claim 10, wherein the printing device comprises a base extension that defines the securing member opening and a portion of the printing medium input tray passageway.

12. The system of claim 10, wherein the printing mechanism is operable to print to photo paper that is located in the printing medium input tray and that is fed to the printing mechanism in part by the operation of the drive mechanism and the feed mechanism.

13. The system of claim 10, wherein the external locking device that is operable to couple to the first reinforced member and the second reinforced member comprises a base that is operable to couple to a securing entity, and a locking member that is operable to extend through the securing member opening, the first slot, and the second slot, and wherein with the external locking device coupled to the first reinforced member and the second reinforced member, the base of the external locking device does not engage the printing device or the printing medium input tray.

14. The system of claim 10, wherein the first slot and the second slot comprise the same dimensions.

15. The system of claim 10, wherein the first slot and the second slot comprise dimensions such that an external locking device may extend through the first slot and the second slot and into a securing channel defined by the second securing member, and the external locking device may be locked such that the external locking device engages the second securing member and cannot be removed through the first slot and the second slot without being unlocked.

16. The system of claim 10, further comprising:

a printing medium positioned in the printing medium input tray, whereby the printing medium input tray is positioned in the printing medium input tray passageway and the first slot and the second slot are aligned.

17. The system of claim 16, further comprising:

an external locking device extending through the first slot and the second slot while being coupled to a securing entity, whereby the external locking device prevents the printing medium input tray from being decoupled from the printing device.

18. The system of claim 17, further comprising:

a securing entity, whereby the printing device is positioned adjacent the securing entity and the external locking device is coupled to the securing entity such that the external locking device secures the printing device to the securing entity.

19. A method for securing a printing device, comprising:

providing a printing device defining a printing medium input tray passageway and a securing member opening located adjacent the printing medium input tray passageway, and comprising a drive mechanism, a printing mechanism, and a first reinforced member that defines a first securing member slot that is located between the securing member opening and the printing medium input tray passageway such that the first reinforced member is operable to couple to an external locking device through the securing member opening;

providing a printing medium input tray comprising a feed mechanism and a second reinforced member that defines a second securing member slot that is operable to couple to an external locking device; and positioning the printing medium input tray in the printing medium input tray passageway and coupling the printing medium input tray to the printing device such that the first securing member slot is located adjacent the second securing member slot such that an external locking device may extend through the securing member opening, the first securing member slot and the second securing member slot, and the drive mechanism engages the feed mechanism to allow a printing medium to be supplied to the printing mechanism.

20. The method of claim 19, further comprising:

positioning a printing medium in the printing medium input tray.

21. The method of claim 20, further comprising:

coupling an external locking device to the printing device and the printing medium input tray by extending a locking member on the external locking device through the securing member opening, the first securing member slot, and the second securing member slot, wherein the locking member extends from a base on the external locking device that does not engage the printing device and the printing medium input tray.

22. The method of claim 20, further comprising:

coupling a cord that extends from the base on the external locking device to a securing entity.

23. A printing device securing apparatus comprising:

a printing device defining a printing medium input tray passageway and a securing member opening located adjacent the printing medium input tray passageway, and including a drive mechanism, a printing mechanism, and a first reinforced member defining a first securing member slot that is located between the securing member opening and the printing medium input tray passageway such that the first reinforced member is operable to couple to an external locking device through the securing member opening; and a printing medium input tray insertable into the input tray passageway to couple with the feed mechanism, the printing medium input tray including a second reinforced member defining a second securing member slot that is operable to couple to the external locking device, wherein the drive mechanism is engagable with the feed mechanism in order to allow a printing medium to be supplied to the printing mechanism and the first securing member slot is alignable with the second securing member slot when the printing medium input tray is inserted in the input tray passageway, whereby, an external locking device is simultaneously insertable through the securing member opening and the aligned first and second securing members slots and securable to an external securing entity.

* * * * *